US006749147B2

(12) United States Patent
Heuser

(10) Patent No.: US 6,749,147 B2
(45) Date of Patent: Jun. 15, 2004

(54) FRICTION WINDING SHAFT FOR REVERSIBLE ROTATION

(75) Inventor: Hans Heuser, Remscheid-Lüttringhausen (DE)

(73) Assignee: Hans-Jorg Heuser, Remscheid-Luttringhausen (DE)

( * ) Notice: Subject to any disclaimer, the term of this patent is extended or adjusted under 35 U.S.C. 154(b) by 0 days.

(21) Appl. No.: 10/305,573

(22) Filed: Nov. 27, 2002

(65) Prior Publication Data

US 2003/0116675 A1 Jun. 26, 2003

(30) Foreign Application Priority Data

Nov. 30, 2001 (EP) ..... 01128585

(51) Int. Cl.[7] ..... B65H 18/08
(52) U.S. Cl. ..... 242/530.3
(58) Field of Search ..... 242/530.3, 576.1, 242/571, 571.1, 571.8, 571.2, 571.3, 571.4, 571.16, 571.7, 573.1; 279/2.06, 2.07, 2.08, 2.09, 213, 2.14, 2.15, 2.21; 269/48.1, 48.2, 48.3, 48.4

(56) References Cited

U.S. PATENT DOCUMENTS 2,280,370 A * 4/1942 Bennett ..... 242/573.1
2,438,673 A * 3/1948 McMahan ..... 242/571.2
3,391,878 A * 7/1968 Naccara ..... 242/571.1
3,552,672 A * 1/1971 Grettve ..... 242/571.2
4,026,488 A * 5/1977 Hashimoto ..... 242/571.2
4,693,431 A * 9/1987 Kataoka ..... 242/571.2
5,375,791 A * 12/1994 Kline et al. ..... 279/2.07
5,451,010 A * 9/1995 Heuser ..... 242/530.3
5,509,618 A * 4/1996 Kleiman et al. ..... 242/571.2
6,402,084 B1 * 6/2002 Michel ..... 242/571.1
6,409,119 B1 * 6/2002 Yabuno ..... 242/571.6
6,513,751 B2 * 2/2003 Michel ..... 242/571.1

* cited by examiner

*Primary Examiner*—William A. Rivera
(74) *Attorney, Agent, or Firm*—McNair Law Firm, PA; Cort Flint

(57) ABSTRACT

A friction winding shaft for roll cutting and winding machines in which the shaft frictionally engages tubular winding cores for winding of strip-shaped bands or similar items. A plurality of winding rings adjoin each other as disposed on a central drive shaft. In addition spring-biased winding core holders protrude from and are distributed over the outer ring surface in the form of clamping elements. The clamping elements are seated in recesses of the rings and are capable of pivoting around axes that are parallel to the friction winding shaft axis. The recesses are provided with stop surfaces which limit the pivoting movement of the clamping elements. In order to further increase the application possibilities of the friction winding shaft the recesses are sized and arranged in such manner that the clamping elements, in their center positions, form a circular curve in which the clamping element tips have a diameter $d_t$ greater than $d_w$ the inside diameter of the winding core.

15 Claims, 2 Drawing Sheets

FRICTION WINDING SHAFT FOR REVERSIBLE ROTATION

BACKGROUND OF THE INVENTION

The instant invention relates to a friction winding shaft, in particular for roll cutting and winding machines wherein tube-shaped winding cores are fitted onto the shaft and driven to wind up strip-shaped bands.

A preferred but not exclusive field of application for this friction winding shaft is the winding of strip-shaped bands or film, such as adhesive strips divided from a production web into narrow strips and wound upon tube-shaped winding cores. In this process several winding cores are slipped next to each other on a shaft and are rotated in a winding direction. The transmission of torque to the winding cores takes place individually through frictional engagement, so that if a blockage occurs only one single winding core stops. At the same time a uniform winding pull is applied by each tube. Thanks to the predictable winding pull, the quality and precision of band winding is improved.

Roll cutting and winding machines using two friction shafts spaced from each other for winding the strip-shaped bands where adjacent bands are wound on different friction winding shafts and every other band is wound on the same friction winding shaft are known (DE 28 56 066 A1). A plurality of adjacent winding rings is slipped on a drive shaft to rotate the winding cores. The rings are provided with longitudinal slits in their outer surface area into which the leaf springs are inserted. The leaf springs extend inclined towards the radial in driving direction and their free ends press with pre-stress against the inner surface area of the winding cores.

Another friction winding shaft comparable in its structural concept but modified in its design is known (DE 42 44 218 C1). Winding core clamping elements in the form of spring-loaded rotating parts are used as holding devices with contact edges projecting from an outer holding ring surface area. The roof-shaped contact edges are somewhat inclined relate to the radial in driving direction and press with the force of a biased spring against the inner surface area of the winding core.

The procedure at the beginning of a winding process, as well as at its completion, is the same for both arrangements described above. The winding cores are first slipped on the rings, and the winding cores are turned on the shaft in the direction of the existing inclination of the leaf springs or with simultaneous pivoting of the clamping elements relative to the radial. The bands to be wound up are then attached to the winding cores and the friction winding shaft is started. When the winding cores are full with wound-up bands, the bands are severed so that the pull tensions on the band ends. To remove the winding cores from the friction winding shaft they are rotated relative to the stopped rings in the previous driving direction. This is possible because this rotation takes place in the direction of the inclination of the core clamping elements (spring-loaded clamping elements or leaf springs). Through rotation in this direction and lateral displacement, the full winding cores can be removed and new winding cores can be installed.

The structure of the friction winding shaft and the arrangement of the installed winding core clamping elements is determined by the operating method of the roll cutting and winding machine, and in particular by the selected direction of shaft rotation.

For the sake of completeness, friction winding shafts elsewhere having a different structure such as shown, for example, in U.S. Pat. No. 4,693,431, are known where ball elements moving in channels inclined towards the outer surface are used as clamping elements.

For these reasons, the direction of rotation in production operation must be known when ordering and installing the friction winding shaft. Care must be taken to ensure uniform installation of the rings and to ensure their proper direction, so that a torsionally effective coupling of the installed winding cores can be ensured. A friction-winding roller provided in this manner can not be used on a roller-cutting and winding machine rotating in the opposite direction because the winding cores would slip. In order to be used with an opposite direction of rotation, the rings would have to be removed from the drive shaft, turned around and reinstalled, causing considerable effort and expenditure.

Accordingly, an object of the present invention is to develop the design of a friction winding roller that is flexible in its application while remaining easy to handle, in particular in the installation of the winding cores.

SUMMARY OF THE INVENTION

The objectives of the invention are accomplished according to the present invention by providing a friction winding shaft and winding cores having the characteristics described in claim 1. Winding rings carried on the friction drive shaft include recesses in which clamping elements are seated which engage and drive the tubular winding cores. The clamping elements are aligned on both sides of the recesses in such manner that the clamping elements of each ring, when in their pivoting stop clamping positions, have clamping tips defining a curve with a diameter that is less than, or at most equal to, an inside diameter $d_w$ of the winding core, while a diameter $d_t$ of a circular curve defined by the clamping element tips in a dead center position is greater than the inside winding core diameter $d_w$. The design of a friction winding shaft according to the invention affords the special advantage that winding cores rotating in either selected direction of rotation may be installed without any problem. A torsionally effective coupling of winding core and the friction winding shaft is ensured in the direction of rotation under load, i.e. during the winding process. Thus, a single friction winding shaft design is required for either direction of rotation. A reduction of manufacturing cost, and in particular logistics costs, is achieved when ordering and shipping, in storage, and in use.

The clamping element no longer bears on a lateral support surface of a ring recess but, contrary to the state of the art, bears with it cylindrical base body on the bottom of the recess. According to a further development of the invention, if the clamping element tip forms a sharp angle $\delta$ with a peripheral force $F_{u1}$ or $F_{u2}$ of the winding core opposite to the direction of rotation $D_1$ or $D_2$ of the drive shaft so that the clamping element is located near the stop position of its pivoting path, the tip is able to engage and interlock more with the inner surface of the winding core.

In a further advantageous development, each winding ring recess for a clamping element is axially symmetrical to an axis of symmetry constituted by a radial of the winding ring whereby the dead center position of each clamping element is aligned with the radial. This is advantageous because of easier installation of the tubular winding cores, and the reliability of the clamping connection under load is found to be equal with either direction of rotation of the friction winding shaft. In order to be able to ensure this symmetrical radial arrangement or dead-center position of each clamping element, a notch for the seating of a spring wire is provided in the clamping element to ensure that the spring loading is aligned orthogonally relative to the axis of symmetry formed by the radial.

Clamping elements with offset tips and a tip angle $\alpha$ of 50° to 60°, preferably 54°, and with bilateral inclines of about 45° (angle of inclination $_Y$), ensure an optimal torsionally strong coupling or clamping connection as well as easy installation of the winding cores. To bring about optimal positive locking between the inside surface of the winding core and the offset clamping element tip, a recess opening $\beta$ of approximately 30° is proposed in connection with the tip angle $\alpha$.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION IF A PREFERRED EMBODIMENT

Figure 1:
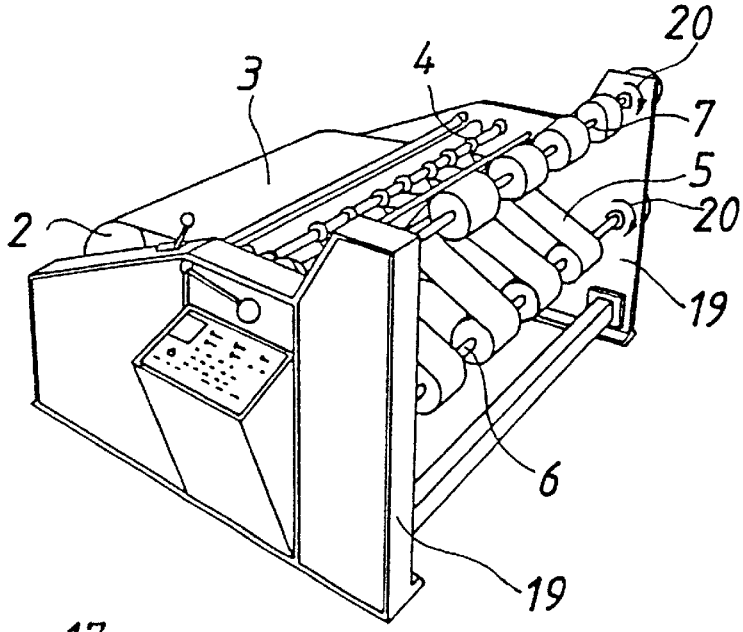
FIG. 1 is a perspective view of a roll cutting and winding machine according to the invention.

Referring now to the drawings, the invention will now be described in more detail.

FIG. 1 illustrates a roll cutting and winding machine in which a web of material 3 is drawn off from a supply roller 2 and is slit by cutting blades 4 into a number of strip-shaped bands 5. The bands are wound up on friction winding shafts 6, 7 whereby alternate bands are wound on friction winding shaft 6, and the intermediate bands on friction winding shaft 7.

Figure 2:
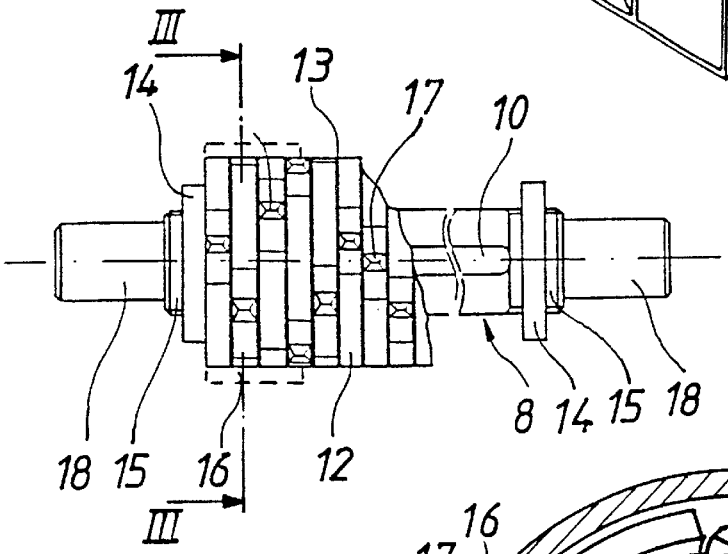
FIG. 2 is a side elevation of a friction winding shaft in part broken away, according to the invention.
Figure 3:
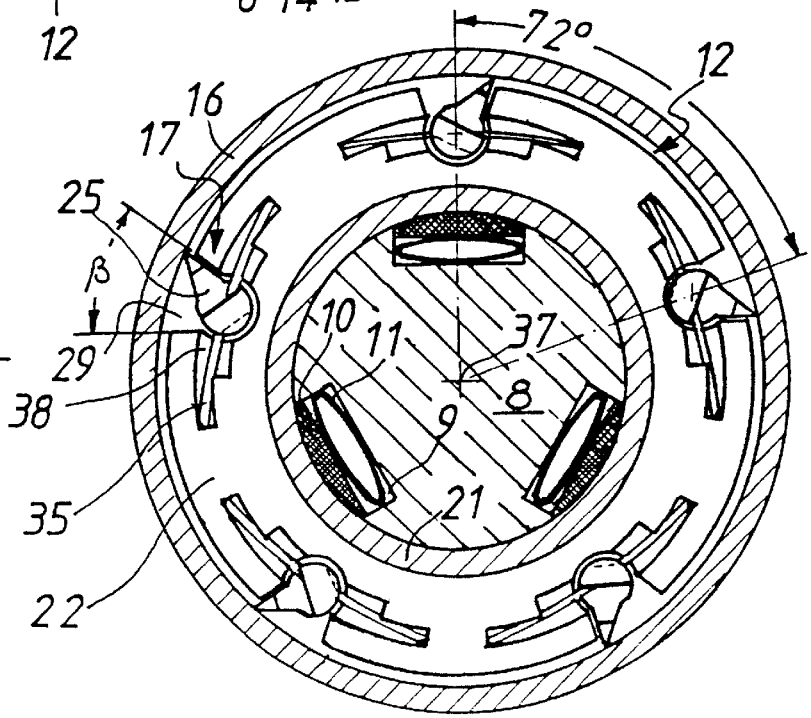
FIG. 3 is a large scale section taken along line III—III of FIG. 2 of a friction winding shaft according to the invention, with clamping elements inserted in recesses.

From a side view of one of the friction winding shafts 6, 7 according to FIGS. 2 and 3, it is apparent that each winding shaft consists of a central drive shaft 8 with three longitudinal grooves 9 in offset arrangement on the circumference. A pressure pad 10 facing outwards, and an expanding hose 11 are inserted in each recess. More than three longitudinal grooves, each containing a pressure pad 10 and an expanding hose 11 can, of course, also be provided alternatively.

Winding rings 12 are slipped onto drive shaft 8. The detail of the winding rings can best be seen in FIGS. 3 and 4. Thin spacer disks 13, preferably having the same outside diameter as rings 12, are inserted between them. Rings 12 are pressed tightly against each other, and fixed in rotation with each other by space disks 13 held together in axial direction by face chucks 14 screwed laterally on thread segments 15. Tubular winding cores 16 are slipped onto rings 12 and held in place by means of spring-loaded winding core holders 17. These rings 12 are narrow so that one winding core 16 normally covers several of them. Each friction winding shaft 6, 7 is seated in lateral cheeks 19 of the roll cutting and winding machine 1 by means of pegs 18 at the front. The friction winding shafts 6, 7 are driven (arrow 20) by drive elements not shown.

When strip bands 5 are wound up, different winding diameters occur due to differences in the thickness of the length of material 3, so that winding cores 16 on the friction winding shaft 6, 7 cannot be driven at the same rotational speed. For this reason, drive shaft 8 cannot be driven at the same rotational speed, and drive shaft 8 is driven at a slightly higher speed than would be necessary to wind up bands 5. Rings 12 on drive shaft 8 are driven through frictional pads 10 so that they slip slightly to compensate for the differences between drive speed and winding speed on drive shaft 8. The magnitude of the frictional engagement can be adjusted by changing the pressure in the expanding hoses 11 pressing against the pressure pads 10.

Figure 4:
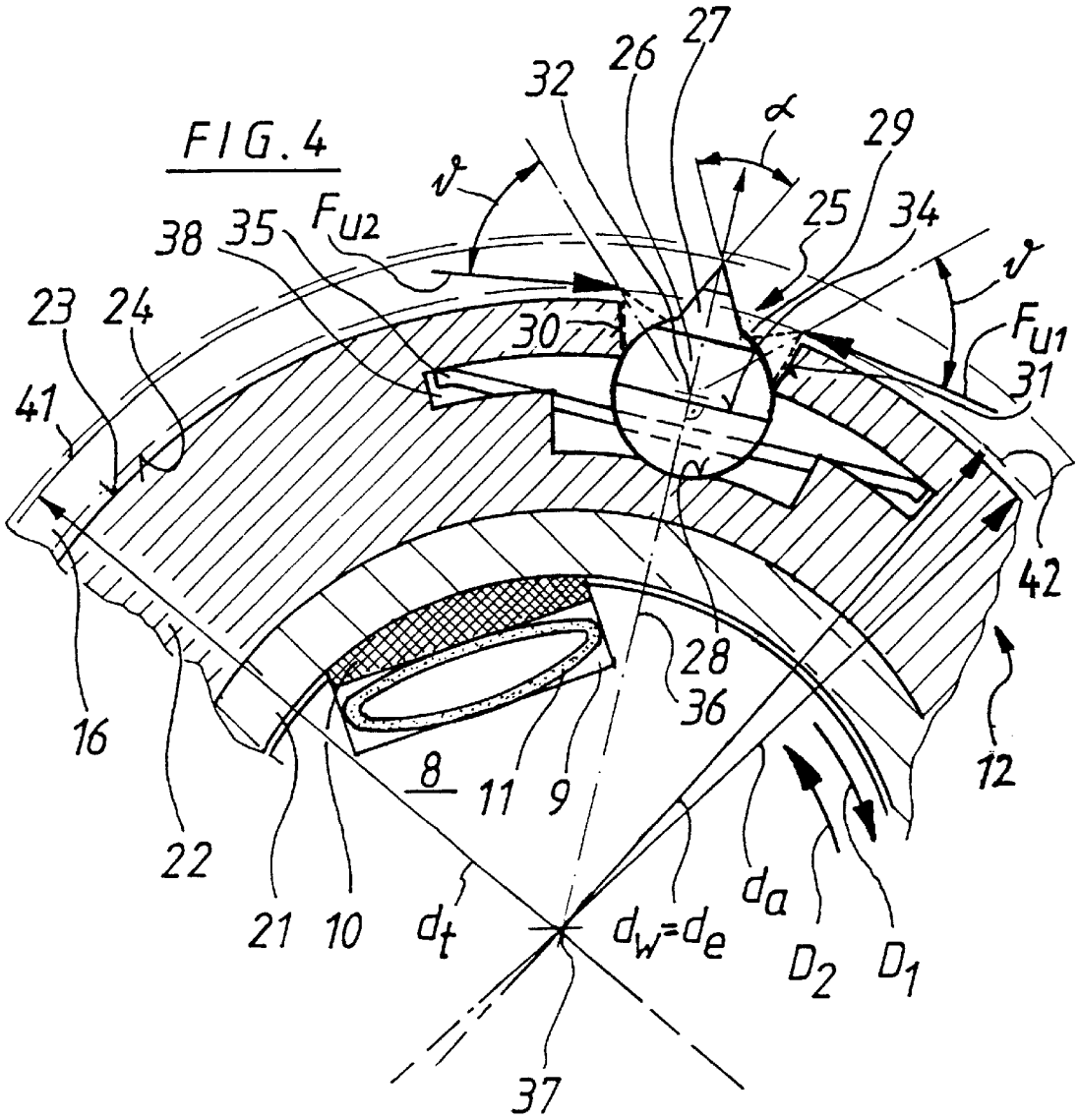
FIG. 4 is an enlarged sectional view of a friction winding shaft with clamping elements according to the invention.

As further shown in FIGS. 3 and 4, each ring 12 is divided into two ring elements that are concentric relative to each other, i.e. an inner friction ring 21, preferably made of metal, and an outer holding ring 22, preferably made of a plastic material. No relative movement is possible between the two. While the pressure pad 10 presses against the inside surface of the friction ring, the holding ring 22 receives the winding core holders 17 over its outer surface. In the illustrated embodiment five winding core holders 17 are provided (distributed as seen over the circumference at a separation 72).

Tubular winding core 16, usually made of paper (cardboard) or plastic, is slipped on holding ring 22, and its inside diameter $d_w$ is slightly larger than outside diameter $d_a$ of holding ring 22. As a result a minimal distance exists between the outer surface 23 of the holding ring and the inside surface 24 of the winding core.

Winding core holder 17 consists of a spring loaded rotating element in form of a clamping element 25 provided with a cylindrical base body 26 and a clamping element tip 27. A tip angle $\alpha$ of 50° to 60°, preferably 54° in the illustrated example, has proven to be especially advantageous. The cylindrical base body 26 bears on cylindrical base 28 of a recess 29 found in outer holding ring surface 23 opening like a funnel having let and right stop surfaces 30, 31, against which edges of clamping element tip 27 bear during pivoting about a pivot axis 32 (FIG. 4). In view of the sharp tip a of 54° the functionality of the invention has proven to be especially advantageous when a recess opening angle $\beta$ of about 30° of recess 29 is provided (FIG. 3).

Figure 5:
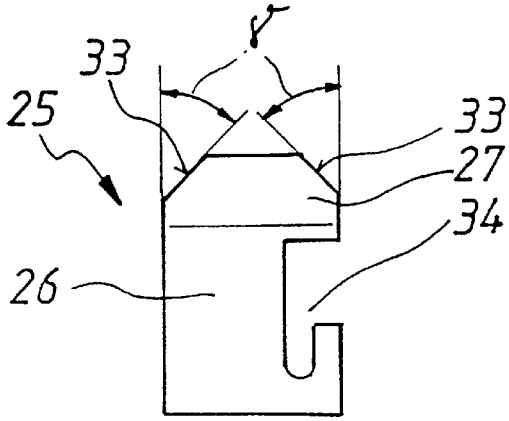
FIG. 5 is a single-part drawing of a clamping element in a side view according to the invention.

Each clamping element 25 is provided with run-up stops 33 on both sides of clamping element tip 27 that have preferably an inclination (inclination angle $_Y$) of 45°, as can be seen in FIG. 5. In addition, clamping element 25 is provided with a notch 34 serving to receive a spring wire 35 to hold the clamping element 25 in a desired starting-position, a dead center position of FIG. 4. Notch 34 is oriented orthogonally relative to an axis of symmetry formed by a radial 36 of the winding ring starting from friction winding shaft axis 37. This results in a radial symmetrical arrangement, or dead-center position, of each clamping element 25. Spring wire 35 ensures this is inserted on the one hand in the notch 34 and on the other hand in a recess 38 of holding ring 22 where it is able to find support at its ends.

All clamping elements 25 are located in their dead-center position to define a circular curve 41 with their respective clamping element tips 27. The circular curve has a diameter $d_t$. A circular curve 42 defined by clamping element tips 27 of clamping elements 25 pivoted in their stop positions contacting stop surfaces 30, 31 has a diameter $d_e$, slightly smaller than or equal to inside winding core diameter $d_w$. Since clamping element 25 bears with its cylindrical base body 26 on cylindrical bottom 28 of recess 29, it is advantageous for reliable interlocking of clamping element tip 27 with the inside winding core surface 24 if clamping element 25 is relatively sharply inclined toward radial 36. That is to say, near its stop position of pivot when under load, i.e. during the winding process. Advantageously, the clamping element tip forms a sharp tipangle d with a circumferential force $F_{u1}$ or $F_{u2}$ directed in opposition to the direction of rotation $D_1$ or $D_2$ of the drive shaft.

In operation, at the beginning of a winding process winding cores 16 are slipped on rings 12. Winding cores 16 are slipped on with a right-side or left-side rotation, depending on the winding direction or drive shaft rotation direction $D_1$ or $D_1$. This causes clamping elements 25 to be correspondingly pivoted relative to the radial 36 (axis of symmetry) so that the installation of winding cores 16 is made possible. Bands 5 are attached to winding cores 16 and the drive shaft is started. The frictional engagement by expanding hoses 11 and pressure pads 10 transmit this drive via friction ring 21 to holding ring 22. Winding core 16 pulled by band 5 exerts an opposite force $F_{u1}$ or $F_{u2}$, so that inside winding core surface 24 interlocks reliably with clamping element tip 27 of clamping elements 25 which are pivoted close to their stop position ensuring a reliable driving connection. When central drive shaft 8 is driven in the opposite direction, a corresponding opposite situation results with regard to the stop pivot position of clamping element 25 or with regard to the force $F_{u1}$ or $F_{u4}$ exerted by the winding core 16 for rotation in an opposite direction.

While a preferred embodiment of the invention has been described using specific terms, such description is for illustrative purposes only, and it is to be understood that changes and variations may be made without departing from the spirit or scope of the following claims.

What is claimed is:

1. A friction winding shaft for roll cutting and winding machine including frictionally engaged tube-shaped winding cores on which strip bands and the like are wound, a plurality of rings disposed on a central drive shaft and adjoining one another, a plurality of winding core clamping elements protruding from an outer surface of said winding rings having clamping element tips, said clamping elements being seated in recesses formed in the winding rings, said clamping elements being pivotally carried in said recesses about a pivot axis parallel with the friction winding shaft axis, and first and second stop surfaces limiting the pivoting movement of the clamping elements, wherein:

said first and second stop surfaces are formed on first and second sides of said winding ring recesses, said recesses providing said clamping elements a first stop position against said first stop surfaces and a second stop position against said second stop surface;

said clamping element tips being formed on free ends of said clamping elements for engaging and exerting a rotational drive force on the winding cores;

said clamping element tips when pivoted to one of said first and second stop positions defining a circular curve having a diameter $d_e$ which is smaller than or equal to the inside diameter $d_w$ of said winding cores; and said clamping element tips having a center position between said first and second stop positions radially aligned with a radial of said rings which defines a circular curve with a diameter $d_t$ greater than inside diameter $d_w$.

2. The apparatus of claim 1 wherein said clamping elements have cylindrical base bodies which bear on a bottom surface of said recesses during winding and said clamping element tips form a sharp tip angle with circumferential forces oriented in opposite directions to the rotational direction of said drive shaft.

3. The apparatus of claim 1 wherein said recesses for said clamping elements are axially symmetrical relative to an axis of symmetry formed by a radial of said winding ring so that a center position of said clamping elements is aligned with said radial.

4. The apparatus of claim 3, including a notch formed in the clamping element attaching a spring wire for spring loading said clamping element orthogonally relative to an axis of symmetry formed by said radial.

5. The apparatus of claim 1 wherein said clamping element tip has a tip angle in a range of about 50° to 60°, and first and second stop abutments are formed on opposing sides of said clamping elements for abutting said first and second stop surfaces having an angle of inclination of 45°.

6. The apparatus of claim 5 wherein said tip angle is approximately 54°.

7. The apparatus of claim 5 wherein said recesses have a funnel-shaped opening accommodating said clamping elements with an opening angle of approximately 30°.

8. A friction winding shaft for a roll cutting and winding machine having frictionally engaged tube-shaped winding cores disposed on the winding shaft on which materials are wound, said friction winding shaft including a plurality of winding rings disposed in juxtaposed positions on a central drive shaft, a plurality of winding core clamping elements protruding from an outer surface of said winding rings having clamping element tips for interlocking with the winding cores for driving the winding cores in rotation, said clamping elements being seated in recesses formed in the winding rings, and said clamping elements being pivotally carried in said recesses about a pivot axis parallel with the friction winding shaft axis, said recesses forming stop surfaces operative to limit the pivoting movement of the clamping elements, said first and second stop surfaces being formed on first and second sides of said winding ring recesses, said recesses providing said clamping elements with first stop positions against said first stop surfaces and second stop positions against said second stop surfaces and a center position defined between said first and second stop positions;

said clamping elements having tips for engaging and exerting a rotational drive force on the winding cores when installed on said winding rings;

said winding rings having a first driving position when said clamping elements are pivoted away from said center position towards said first stop positions wherein said clamping elements are engaged with said winding cores for driving said winding cores in a first rotational direction and a second driving position when said clamping elements are pivoted away from said center position towards said second stop positions wherein said clamping elements are engaged with said winding cores for driving said winding cores in a second rotational direction; and said first and second driving positions being selectable when installing said winding cores without removing said winding rings from said friction shaft so that the rotational direction of said winding cores may be selected depending on the selected of said driving positions during installing of said cores.

9. The apparatus of claim 8 including a circular curve defined by said clamping element tips when pivoted to one of said first and second stop positions having a diameter $d_e$ which is smaller than or equal to a diameter $d_w$, the inside diameter of said winding cores; and said clamping element tips having a center position between said first and second stop positions radially aligned with a radial of said winding rings which defines a circular curve with a diameter $d_t$ greater than $d_w$.

10. The apparatus of claim 8 wherein said clamping elements have cylindrical base bodies which bear on a bottom surface of said recesses during winding and said clamping element tips form a sharp tip angle with circumferential forces oriented in opposite directions to the rotational direction of said drive shaft.

11. The apparatus of claim 8 wherein said recesses for said clamping elements are axially symmetrical relative to an axis of symmetry formed by a radial of said winding ring so that a center position of said clamping elements is aligned with said radial.

12. The apparatus of claim 8, including a notch formed in the clamping element attaching a spring wire for spring loading said clamping element orthogonally relative to an axis of symmetry formed by said radial.

13. The apparatus of claim 8 wherein said clamping element tips have a tip angle in a range of about 50° to 60°, and first and second stop abutments are formed on opposing sides of said clamping elements for abutting said first and second stop surfaces having an angle of inclination of 45°.

14. The apparatus of claim 13 wherein said tip angle is approximately 54°.

15. The apparatus of claim 14 wherein said recesses have a funnel-shaped opening accommodating said clamping elements with an opening angle of approximately 30°.

* * * * *